US008888319B2

(12) United States Patent
Lee et al.

(10) Patent No.: US 8,888,319 B2
(45) Date of Patent: Nov. 18, 2014

(54) LED PROJECTION LAMP HAVING A CYLINDRICAL HEAT SINK

(71) Applicant: Zhongshan Weiqiang Technology Co., Ltd., Zhongshan, Guangdong (CN)

(72) Inventors: Ke-Chin Lee, Zhongshan (CN); Hung-Chieh Chen, Zhongshan (CN)

(73) Assignee: Zhongshan Weiqiang Technology Co., Ltd., Zhongshan, Guangdong (CN)

( * ) Notice: Subject to any disclaimer, the term of this patent is extended or adjusted under 35 U.S.C. 154(b) by 173 days.

(21) Appl. No.: 13/632,190

(22) Filed: Oct. 1, 2012

(65) Prior Publication Data

US 2013/0223064 A1 Aug. 29, 2013

(30) Foreign Application Priority Data

Feb. 27, 2012 (CN) ..... 2012 1 0044412

(51) Int. Cl.
*F21V 11/14* (2006.01)
*H01J 61/52* (2006.01)

(52) U.S. Cl.
USPC ..... 362/235; 313/46

(58) Field of Classification Search
USPC ..... 362/235; 313/46
See application file for complete search history.

(56) References Cited

U.S. PATENT DOCUMENTS

2009/0323348 A1* 12/2009 Shuai et al. ..... 362/294
2010/0046223 A1* 2/2010 Li et al. ..... 362/249.02
2011/0280015 A1* 11/2011 Li et al. ..... 362/240

* cited by examiner

*Primary Examiner* — Joseph L Williams
(74) *Attorney, Agent, or Firm* — Jackson IPG PLLC

(57) ABSTRACT

A LED projection lamp includes a heat sink, a lamp cup, an LED module, a lens, a first heat conduction component, a fastening device and a second heat conduction component. The heat sink is cylindrical and provided with a trumpet-shaped inner cavity on the front and a cylindrical inner cavity at the rear. The lamp cup is arranged inside the trumpet-shaped inner cavity and the LED module is disposed on a small opening portion of the lamp cup. The lens is used by the LED module for light transmission, the first heat conduction component includes a first vapor chamber, the fastening device is sleeved at the rear end of the cylindrical inner cavity, and the second heat conduction component includes a second vapor chamber.

11 Claims, 6 Drawing Sheets

LED PROJECTION LAMP HAVING A CYLINDRICAL HEAT SINK

FIELD OF THE INVENTION

The invention relates to a projection lamp, in particular to an LED projection lamp.

BACKGROUND OF THE INVENTION

LED projection lamps are also known as linear LED projection lamps and the like. As the LED projection lamps take the shape of strips, they are also known as LED line lamps. The LED projection lamps are mainly applied to field lighting and architectural decorative lighting and used for drawing the outlines of buildings and fields. As the LED projection lamps are widely used, the illumination direction of the LED projection lamps is required to be relatively flexible and often required to be adjusted according to field or real-time demands. If the LED projection lamps illuminate in different directions, the transmission path of the heat produced by the LED projection lamps will be certainly affected. More severely, the heat cannot be effectively dispersed in some directions and then excessive heat is accumulated. Therefore, the use reliability and the service life of the LED projection lamps may be affected. The heat dissipation capability of LED lamps is closely interrelated to stable operation, good quality and long service life of the LED lamps. As for LED projection lamps with high brightness requirement, as the heat produced is abundant and the illumination environment is inconstant, the heat dissipation performance of the LED projection lamps is even more crucial. Therefore, when the LED projection lamps illuminate at different angles and in different directions, how to realize optimal heat dissipation, how to not affect the heat dissipation performance in the illumination direction and how to realize uniform heat dissipation at any angle are technical problems necessary to be solved.

SUMMARY OF THE INVENTION

The technical problem to be solved by the invention is to provide an LED projection lamp which has good heat dissipation performance and can realize effective heat dissipation at different angles.

The technical proposal adopted by the invention to solve the technical problem is that:

The invention relates to an LED projection lamp, which comprises:

a heat sink, in which the heat sink is cylindrical; a heat dissipation structure is arranged on the cylindrical periphery of the heat sink; and a trumpet-shaped inner cavity gradually expanded from inside to outside is formed at the front end of a cylindrical inner cavity of the heat sink;

a lamp cup, in which the lamp cup takes the shape of a trumpet which is matched with the trumpet-shaped inner cavity of the heat sink and has a large opening portion and a small opening portion; the large opening portion is clamped on the outer edge at the front end of the heat sink; and the small opening portion is disposed in the inner cavity of the heat sink;

an LED module, in which the LED module is formed by a plurality of LED chips packaged on an aluminum nitride ceramic wafer and disposed on the small opening portion of the lamp cup;

a lens, in which the lens is used by the LED module for light transmission and fixed at the front end of the heat sink through a retainer ring;

a first heat conduction component, in which the first heat conduction component comprises a first vapor chamber which is bent to form a smoothing section and two symmetrical sections symmetrically disposed on both sides of the smoothing section; the LED module is fixed on the front of the smoothing section of the first vapor chamber; the two symmetrical sections of the first vapor chamber are extended to the vicinity of the large opening portion from the small opening portion of the lamp cup; inner side faces of the two symmetrical sections of the first vapor chamber are cambered surfaces and adhered to the outerwall of the lamp cup; and outer side faces of the two symmetrical sections of the first vapor chamber are cambered surfaces and adhered to the wall of the trumpet-shaped inner cavity of the heat sink;

a mounting plate, in which the mounting plate is disposed on the smoothing section of the first vapor chamber; and the first vapor chamber and the second vapor chamber are supported and fixed by the mounting plate;

a fastening device, in which the fastening device is cylindrical and sleeved at the rear end of the cylindrical inner cavity of the heat sink; and a second heat conduction component, in which the second heat conduction component comprises a second vapor chamber which is bent to form a smoothing section and two symmetrical sections symmetrically disposed on both sides of the smoothing section; the smoothing section of the second vapor chamber is supported and fixed by a mounting plate; the two symmetrical sections of the second vapor chamber are sleeved outside the fastening device; inner side faces of the two symmetrical sections of the second vapor chamber are cambered surfaces and adhered to the outerwall of the fastening device; and outer side faces of the two symmetrical sections of the second vapor chamber are cambered surfaces and adhered to the wall of the cylindrical inner cavity of the heat sink.

As a further improvement of the proposal, the first heat conduction component also comprises a first heat pipe component having at least one heat pipe which is bent and surrounds the periphery of the lamp cup; a first groove for receiving the first heat pipe component is formed on the outerwall of the lamp cup; and the outside of the heat pipe of the first heat pipe component makes contact with the wall of the trumpet-shaped inner cavity of the heat sink and the inner side faces of the two symmetrical sections of the first vapor chamber.

Similarly, as a further improvement of the proposal, the second heat conduction component also comprises a second heat pipe component having at least one heat pipe which is bent and surrounds the periphery of the fastening device; a second groove for receiving the second heat pipe component is formed on the outerwall of the fastening device; and the outside of the heat pipe of the second heat pipe component makes contact with the wall of the cylindrical inner cavity of the heat sink and the inner side faces of the two symmetrical sections of the second vapor chamber.

Wherein, the total radiating power of the first and second heat conduction components is more than or equal to the power produced by the LED module.

Wherein, the heat conduction path is as follows: the heat is directly conducted from the LED chips to the aluminum nitride ceramic wafer first, then directly conducted to the vapor chambers, finally conducted to heat pipes, an inner radiator and an outer radiator, and dispersed by fin devices of the radiators via cross-ventilation and radiation, in which the aluminum nitride ceramic wafer, the vapor chambers and the heat pipes are all heat conducting media with low thermal resistance.

Moreover, one side of the heat pipe of the first heat pipe component, which makes contact with the first vapor chamber and the wall of the trumpet-shaped inner cavity of the heat sink, is subjected to flattening treatment.

Furthermore, one side of the heat pipe of the second heat pipe component, which makes contact with the second vapor chamber and the wall of the cylindrical inner cavity of the heat sink, is subjected to flattening treatment.

A first clamping groove into which the smoothing section of the first vapor chamber is clamped is formed on the front of the mounting plate; and a second clamping groove into which the smoothing section of the second vapor chamber is clamped is formed at the rear of the mounting plate.

An outward flange is formed on the outer edge at the front end of the heat sink; and the retainer ring is clamped on the outward flange.

The lens is a Fresnel lens, is a concentric lens, and can uniformly emit light.

A light-transmitting mirror for covering the lens is clamped on the retainer ring.

The LED projection lamp has the advantages that: as the LED projection lamp adopts the heat conduction components comprising the vapor chambers and the heat pipes to conduct heat for the LED module and the heat conduction components can realize high-efficiency heat exchange via internal working media, the heat of the LED module can be quickly conducted to the heat sink, the lamp cup and the fastening device and then effectively dispersed in time, and thus good radiating effect can be achieved.

As the heat conduction components comprising the vapor chambers and the heat pipes realize quick heat conduction through the working media and have directivity during the operation, the heat conduction performance of the heat conduction components may be affected when the LED projection lamp illuminates in different directions. In order to solve the problem, the LED projection lamp adopts two heat conduction components, namely the first heat conduction component and the second heat conduction component which are respectively disposed on the front and at the rear of a heat source, namely the LED module. Therefore, when the LED projection lamp illuminates upwards, the first heat conduction component has optimal heat dissipation efficiency and has the function of primary heat dissipation. When the LED projection illuminates downwards, the second heat conduction component has optimal heat dissipation efficiency and has the function of primary heat dissipation. Obviously, due to the interaction between the first and second heat conduction components, the heat conduction efficiency of the LED projection lamp can be always maintained to be high enough, and thus the LED projection lamp can have good heat dissipation efficiency when illuminating in any direction.

BRIEF DESCRIPTION OF THE DRAWINGS

In order to more clearly illustrate the technical proposals of the embodiments of the invention, brief description is given to the attached drawings required to be used in the illustration of the embodiments. Obviously, the attached drawings illustrated are only one part of embodiments of the invention and not all the embodiments. Those skilled in the art can also obtain other design proposals and attached drawings on the basis of the attached drawings on the premise of not offering creative work.

DETAILED DESCRIPTION OF THE PREFERRED EMBODIMENTS

Clear and complete description is given to the concept, specific structure and technical effects achieved of the invention with the attached embodiments and drawings, so that those skilled in the art can fully understand the objectives, characteristics and advantages of the invention. Obviously, the embodiments illustrated are only one part of embodiments of the invention and not all the embodiments. Other embodiments obtained by those skilled in the art on the basis of the embodiments of the invention on the premise of not offering creative work shall be all within the scope of protection of the invention.

Figure 1:
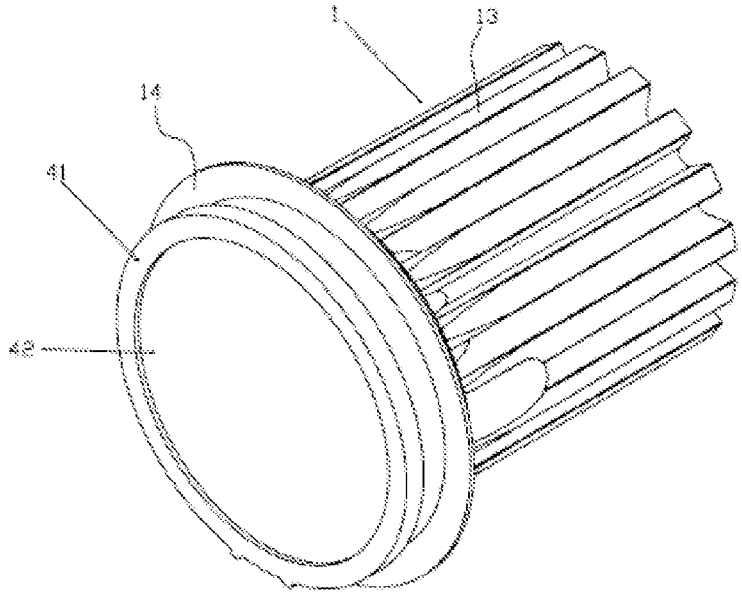
FIG. 1 is a stereogram of the LED projection lamp provided by the invention.
Figure 2:
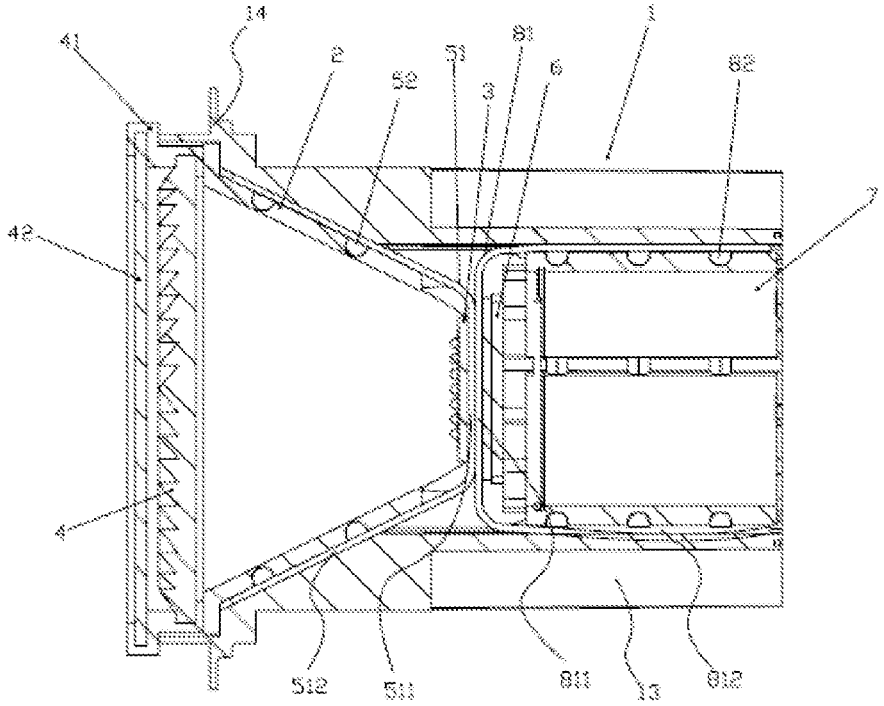
FIG. 2 is a section view of the LED projection lamp provided by the invention.
Figure 3:
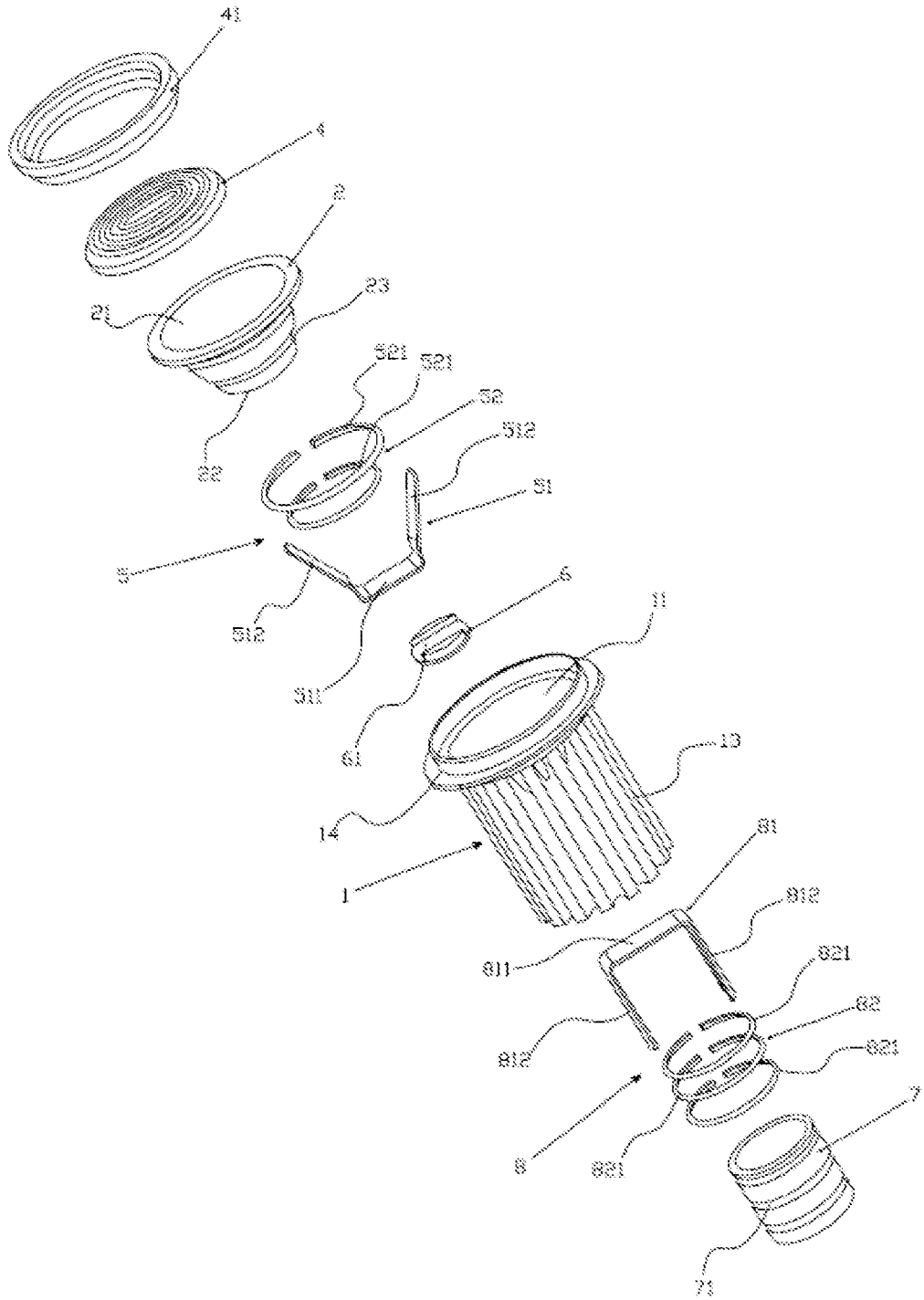
FIG. 3 is an exploded view of the LED projection lamp provided by the invention.

As illustrated in FIGS. 1 to 3, the LED projection lamp provided by the invention mainly comprises a heat sink 1, a lamp cup 2, an LED module 3, a lens 4, a first heat conduction component 5, a mounting plate 6, a fastening device 7 and a second heat conduction component 8.

Figure 4:
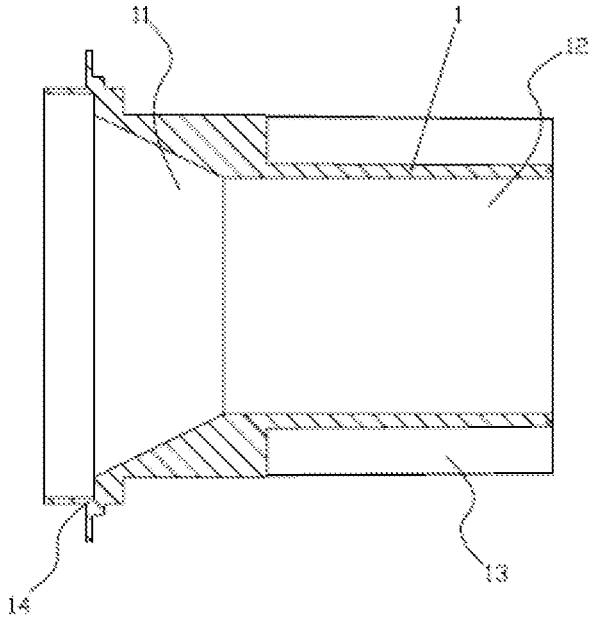
FIG. 4 is a section view of a heat sink of the LED projection lamp provided by the invention.

Wherein, the heat sink 1 is cylindrical. As illustrated in FIG. 4, the heat sink 1 has a cylindrical inner cavity 12; a heat dissipation structure 13 is arranged on the cylindrical periphery of the heat sink, can be a radiating fin or a heat dissipation channel capable of producing stack effect, and most frequently can be extended along the axial direction of the cylindrical periphery; a trumpet-shaped inner cavity 11 gradually expanded from inside to outside is formed at the front end of the cylindrical inner cavity 12 of the heat sink 1; a large opening of the trumpet-shaped inner cavity 11 is disposed outwards and a small opening of the trumpet-shaped inner cavity 11 is disposed inwards; and the trumpet-shaped inner cavity 11 is combined with the cylindrical inner cavity 12.

Figure 5:
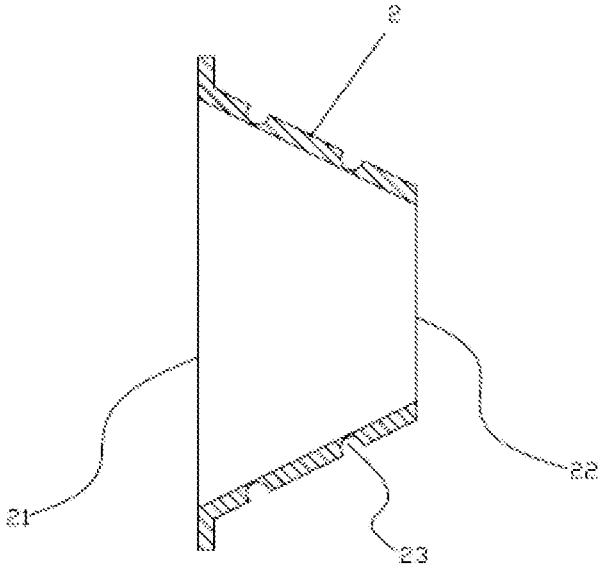
FIG. 5 is a section view of a lamp cup of the LED projection lamp provided by the invention.

Wherein, the lamp cup 2 takes the shape of a trumpet which is matched with the trumpet-shaped inner cavity 11 of the heat sink 1. As illustrated in FIG. 5, the lamp cup 2 has a large opening portion 21 and a small opening portion 22, wherein the large opening portion 21 is clamped on the outer edge at the front end of the heat sink 1 and just covers the trumpet-shaped large opening of the heat sink 1; and the small opening portion 22 is disposed in the cylindrical inner cavity 12 of the heat sink 1 and can be extended to the trumpet-shaped small opening of the heat sink 1 and cover the trumpet-shaped small opening of the heat sink 1.

Wherein, the LED module 3 is formed by a plurality of LED chips packaged on an aluminum nitride ceramic wafer, disposed in the cylindrical inner cavity 12 of the heat sink 1, and positioned on the small opening portion 22 of the lamp cup 2. The light-emitting direction of the LED module 3 is towards the large opening portion 21 of the lamp cup 2, so that the light emitted can be emitted from the lamp cup 2 and the lamp cup 2 also has the function of reflecting condensation.

Wherein, the lens 4 is used by the LED module 3 for light transmission and fixed at the front end of the heat sink 1 through a retainer ring 41 and covers the large opening of the heat sink 1 and the large opening portion 21 of the lamp cup 2, so that the light emitted by the LED module 3 can pass through the lens 4 together and then be emitted, and thus the lens 4 has the function of light concentration. For the convenience of clamping the lens 4 and leaving space for a clamping and matching structure for the outside, an outward flange 14 can be formed on the outer edge at the front end of the heat sink 1, and the retainer ring 41 is clamped on the outward flange 14 and tightly locks the lens 4. The lens 4 of the LED projection lamp provided by the invention is preferably a Fresnel lens of which one side is a smooth surface and the other side is provided with concentric circles from small to large by engraving. The whole lens is relatively thin, so the assembly of other structures of the projection lamp may not be affected. Moreover, the lens can also have the functions of good light transmission and focusing. Therefore, the lens is applicable to the projection lamp. Of course, the lens 4 can also adopt an optical lens such as a convex lens and a concave lens. In the case that the Fresnel lens is adopted, in order to protect the lens and the internal structure and realize the sealing, water resistance and dust prevention, a light-transmitting mirror 42 for covering the lens 4 can be also clamped on the retainer ring 41. Herein, it is equivalent that the light-transmitting mirror 42 is disposed on the outmost layer and can be directly seen by people, the lens 4 disposed on the inside and the LED module 3 disposed on the innermost side. In an actual structure, a circle of annular clamping grooves can be formed in the retainer ring 41 and used for clamping the light-transmitting mirror 42.

The LED module 3 may produce heat in the working process. In the optimal situation, the heat must be transmitted to the heat sink 1 in time and dispersed in time through the heat dissipation structure 13 of the heat sink 1. In order to be close to the optimal situation as much as possible, the LED projection lamp provided by the invention adopts the first heat conduction component 5 and the second heat conduction component 8.

Figure 6:
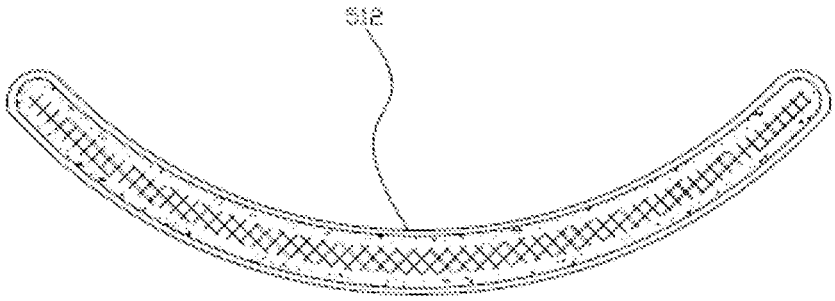
FIG. 6 is a section view of a symmetrical section for a first vapor chamber of the LED projection lamp provided by the invention.

The first heat conduction component 5 mainly comprises a first vapor chamber 51 which is bent to form a smoothing section 511 and two symmetrical sections 512 symmetrically disposed on both sides of the smoothing section 511, wherein the first vapor chamber 51 is integrally disposed in the cylindrical inner cavity 12 of the heat sink 1. The front face of the smoothing section 511 is taken as a fixing surface and used for fixing the LED module 3 and generally can adopt mount welding or bonding, so that the bottom of the LED module 3 can make contact with and be adhered to the smoothing section 511 completely, and thus optimum heat conduction capability can be achieved. Correspondingly, the smoothing section 511 is disposed at the rear of the small opening portion 22 of the lamp cup 2. Moreover, the two symmetrical sections 512 of the first vapor chamber 51 are symmetrical to each other and extended to the vicinity of the large opening portion 21 from the small opening portion 22 of the lamp cup 2. Furthermore, inner side faces of the two symmetrical sections 512 are cambered surfaces and adhered to the outerwall of the lamp cup 2 and outer side faces of the two symmetrical sections 512 are cambered surfaces and adhered to the wall of the trumpet-shaped inner cavity 11 of the heat sink 1. During the production, cross sections of the two symmetrical sections 512 can be directly bent for a certain radian, and the extending direction of the two symmetrical sections 512 is similar to that of the lamp cup 2, namely the two symmetrical sections 512 are extended by being spread out in the shape of a trumpet, so that the whole first vapor chamber 51 can be formed by bending. The structure of the symmetrical section 512 is as illustrated in FIG. 6. It is notable that a capillary structure and a working solution are formed inside the vapor chamber and are important for the heat conduction of the vapor chamber. By adoption of the structure, the two symmetrical sections 512 of the first vapor chamber 51 are completely adhered to the lamp cup 2 and the trumpet-shaped inner cavity 11 of the heat sink 1, so that tight contact can be realized. Therefore, the heat produced by the LED module 3 can be quickly transmitted along the two symmetrical sections 512 via the smoothing section 511 of the first vapor chamber 51; a great part of the heat is transmitted to the heat sink 1 via the wall of the trumpet-shaped inner cavity 11 and dispersed by the heat dissipation structure 13 of the heat sink 1; and a small part of the heat is transmitted to the lamp cup 2 via the outerwall of the lamp cup 2 and dispersed by the lamp cup 2.

Figure 7:
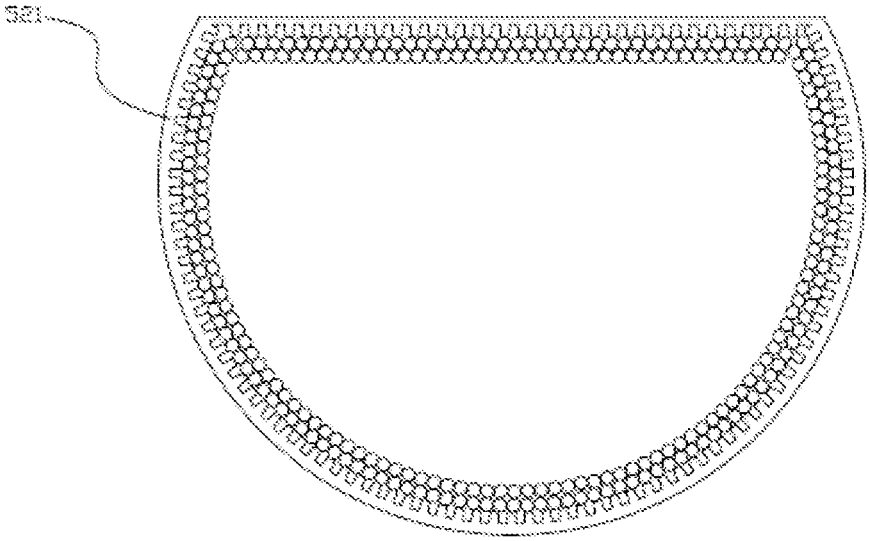
FIG. 7 is a section view of a heat pipe for a first heat pipe component of the LED projection lamp provided by the invention.

As adhered portions of the two symmetrical sections 512 of the first vapor chamber 51 and the trumpet-shaped inner cavity 11 and the outerwall of the lamp cup 2 cannot completely cover the whole wall of the trumpet-shaped inner cavity 11 or the outerwall of the lamp cup 2, the heat distributed to the heat sink 1 and the lamp cup 2 may be not uniform enough during the heat conduction, and thus the heat dissipation efficiency may be affected. In order to solve the problem, a first heat pipe component 52 is also arranged inside the first heat conduction component 5 and has at least one heat pipe 521, wherein each heat pipe 521 is bent and surrounds the periphery of the lamp cup 2 and is adhered to the lamp cup 2; and the rear of the heat pipe 521 makes contact with the wall of the trumpet-shaped inner cavity 11 of the heat sink 1 or the inner side faces of the two symmetrical sections 512 of the first vapor chamber 51 in view of different positions. In order to realize reasonable structure and convenient assembly, a first groove 23 with appropriate dimension can be formed on the outerwall of the lamp cup 2 and used for clamping each heat pipe 521 of the first heat pipe component 52. In addition, as illustrated in FIG. 7, the outer side face of each heat pipe 521, namely one side of the heat pipe 521, which makes contact with the two symmetrical sections 512 of the first vapor chamber 51 and the wall of the trumpet-shaped inner cavity 11 of the heat sink 1, is subjected to flattening treatment, so that the outer side face of each heat pipe 521 can be adhered to the two symmetrical sections 512 of the first vapor chamber 51 and the wall of the trumpet-shaped inner cavity 11 of the heat sink 1 as much as possible, and thus the heat dissipation efficiency can be guaranteed. It is notable that in the internal schematic diagram of a sintered heat pipe as illustrated in FIG. 7, a working solution and a composite structure having a capillary and a slot, in the heat pipe are important for the implementation of good heat conduction efficiency of the heat pipe.

The mounting plate 6 additionally arranged of the LED projection lamp provided by the invention can be used for supporting and fixing the first vapor chamber 51 and is disposed on the smoothing section 511 of the first vapor chamber 51 in the overall structure. The mounting plate 6 can be disposed on the front of the smoothing section 511 and can be also disposed at the rear of the smoothing section 511. The case that the mounting plate 6 is disposed at the rear of the smoothing section 511 is illustrated below. In the case, a concave clamping groove 61 can be usually formed on the front of the mounting plate 6 and is used for clamping the smoothing section 511, so that stable fixation can be realized. The other function of the mounting plate 6 is to fix the second heat conduction component 8. Moreover, in order to fix the second heat conduction component 8 and relevant internal components, the cylindrical fastening device 7 is additionally sleeved at the rear of the cylindrical inner cavity of the heat sink 1.

In a specific structure, the second heat conduction component 8 mainly comprises a second vapor chamber 81. Similarly, the second vapor chamber 81 is bent to form a smoothing section 811 and two symmetrical sections 812 symmetrically disposed on both sides of the smoothing section 811, wherein the smoothing section 811 is supported and fixed by the mounting plate 6. As similar to the first vapor chamber 51, the mounting plate 6 can be also arranged on the front or at the rear of the smoothing section 811 of the second vapor chamber 81. In order to be matched with the above embodiment and achieve optimal heat transmission efficiency, the second vapor chamber 81 must be close to the LED module 3 freely as much as possible. Therefore, the mounting plate 6 can be preferably arranged at the rear of the smoothing section 811 of the second vapor chamber 81, so that the smoothing section 811 of the second vapor chamber 81 can make contact with the smoothing section 511 of the first vapor chamber 51. In the above embodiment, the clamping groove 61, used for fixing the smoothing section 511 of the first vapor chamber 51, on the mounting plate 6 can be designed to be deep relatively and used for fixing the smoothing section 811 of the second vapor chamber 81 as well. The two symmetrical sections 812 symmetrically disposed on the smoothing section 811 are extended towards the rear end of the heat sink 1 and sleeved outside the fastening device 7 to form a structure which covers the outerwall of the fastening device 7. Moreover, inner side faces of the two symmetrical sections 812 must be guaranteed to be bent to be cambered surfaces and adhered to the cylindrical outerwall of the fastening device 7, and outer side faces of the two symmetrical sections 812 must be guaranteed to be cambered surfaces and adhered to the wall of the cylindrical inner cavity 12 of the heat sink 1, and thus tight contact between the second vapor chamber 81 and the heat sink 1 and the fastening device 7 can be realized. Therefore, the heat produced by the LED module 3 can be quickly transmitted along the two symmetrical sections 812 via the smoothing section 811 of the second vapor chamber 81; a great part of the heat is transmitted to the heat sink 1 via the wall of the cylindrical inner cavity 12 of the heat sink 1 and dispersed by the heat dissipation structure 13 of the heat sink 1; and a small part of the heat is transmitted to the fastening device 7 via the outerwall of the fastening device 7 and dispersed by the fastening device 7. Similarly, just like the first vapor chamber 51 as illustrated in FIG. 6, the second vapor chamber 81 can be directly bent and formed during the production, and cross sections of the two symmetrical sections 812 of the second vapor chamber 81 are bent for a certain radian, so that the two symmetrical sections 812 can be completely matched with the wall of the cylindrical inner cavity 12 of the heat sink 1 and the outerwall of the fastening device 7.

As adhered portions of the two symmetrical sections 812 of the second vapor chamber 81 and the cylindrical inner cavity 12 and the outerwall of the fastening device 7 cannot completely cover the whole wall of the cylindrical inner cavity 12 or the outerwall of the fastening device 7, the heat distributed to the heat sink 1 and the fastening device 7 may be not uniform enough during the heat conduction, and thus the heat dissipation efficiency may be affected. In order to solve the problem, a second heat pipe component 82 is also arranged inside the second heat conduction component 8 and has at least one heat pipe 821, wherein each heat pipe 821 is bent and surrounds the periphery of the fastening device 7 and is adhered to the fastening device 7; and the rear of the heat pipe 821 makes contact with the cylindrical inner cavity 12 of the heat sink 1 or the inner side faces of the two symmetrical sections 812 of the second vapor chamber 81 in view of different positions. In order to realize reasonable structure and convenient assembly, a second groove 71 with appropriate dimension can be formed on the outerwall of the fastening device 7 and used for clamping each heat pipe 821 of the second heat pipe component 82. In addition, the outer side face of each heat pipe 821, namely one side of the heat pipe 821, which makes contact with the two symmetrical sections 812 of the second vapor chamber 81 and the wall of the cylindrical inner cavity 12 of the heat sink 1, is subjected to flattening treatment, so that the outer side face of each heat pipe 821 can be adhered to the two symmetrical sections 812 of the second vapor chamber 81 and the wall of the cylindrical inner cavity 12 of the heat sink 1 as much as possible, and thus the heat dissipation efficiency can be guaranteed. The structure of the heat pipe 821 after flattening can also refer to the heat pipe 521 of the first heat pipe component 52 as illustrated in FIG. 7.

As seen from the above structure, the heat produced by the LED module 3 can be dispersed via two paths which are respectively the first heat conduction component 5 and the second heat conduction component 8. As both the first heat conduction component 5 and the second heat conduction component 8 adopt superconducting components such as the heat pipes and the vapor chambers, very high heat conduction efficiency can be realized and the heat can be quickly transmitted to the heat sink 1 having the function of primary heat dissipation and the lamp cup 2 and the fastening device 7 having the function of secondary heat dissipation and then dispersed.

Commonly fixed and mounted lighting fixtures usually have good radiating effect by only adopting a superconducting component such as a vapor chamber and a heat pipe. However, the illumination direction of projection lamps may need to be adjusted at any moment due to the differences in workplaces and functions, so the projection lamps usually do not have fixed illumination angle. As is now well known, the superconducting component such as the vapor chamber and the heat pipe has directionality during the heat conduction: when a heat source is disposed on the lower part and the heat is dispersed upwards, the heat conduction is relatively fast and the efficiency is relatively high; and when the heat source is disposed on the upper part and the heat is dispersed downwards, the heat conduction is relatively slow and the efficiency is relatively low. The reason of the phenomenon is that: as the reflux of a working solution in the superconducting component may be affected by gravity, the working solution is refluxed downwards to the heat source during the condensing reflux, and the process is obviously faster than the case that the working solution is refluxed upwards due to the gravity action.

Due to the above factors, the LED projection lamp provided by the invention adopts two superconducting components, namely the first heat conduction component 5 and the second heat conduction component 8, to achieve perfect radiating effect. More specifically, the process can be discussed from two extreme directions: (1) when the projection lamp illuminates downwards; and (2) when the projection lamp illuminates upwards.

Figure 8:
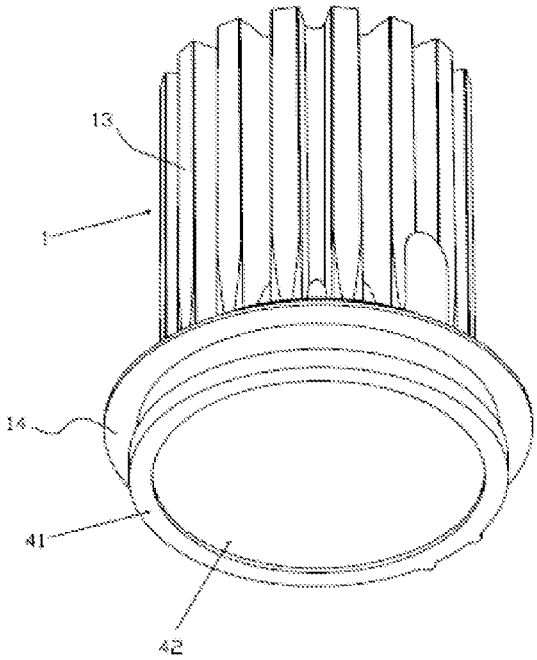
FIG. 8 is a structure diagram of the LED projection lamp provided by the invention when illuminating downwards.
Figure 10:
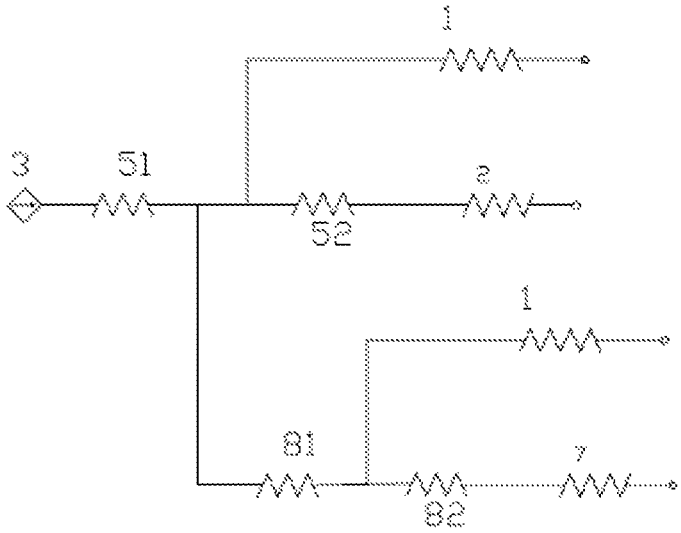
FIG. 10 is a schematic diagram of an equivalent heat dissipation path of the LED projection lamp provided by the invention.

(1) When the Projection Lamp Illuminates Downwards:

As illustrated in FIG. 8, when the projection lamp illuminates at the angle, the LED module 3 as the heat source is disposed on the lower part relative to the first heat conduction component 5 and disposed on the upper part relative to the second heat conduction component 8. That is to say, in the state, the first heat conduction component 5 has higher heat conduction efficiency compared with the second heat conduction component 8. Therefore, the first heat conduction component 5 has the function of primary heat dissipation. As illustrated in FIG. 10, the heat dissipation path of the first heat conduction component 5 is as follows: the heat is transmitted from the LED module 3 to the first vapor chamber 51; one part of the heat in the first vapor chamber 51 is directly transmitted to the heat sink 1 and the lamp cup 2 and the other part of the heat in the first vapor chamber 51 is transmitted to the first heat pipe component 52 first and then transmitted to the heat sink 1 and the lamp cup 2 by the first heat pipe component 52. The second heat conduction component 8 has the function of secondary heat dissipation. As illustrated in FIG. 11, the heat dissipation path of the second heat conduction component 8 is as follows: the heat is transmitted from the LED module 3 to the second vapor chamber 81; and one part of the heat in the second vapor chamber 81 is directly transmitted to the heat sink 1 and the fastening device 7 and the other part of the heat in the second vapor chamber 81 is transmitted to the second heat pipe component 82 first and then transmitted to the heat sink 1 and the fastening device 7 by the second heat pipe component 82.

Figure 9:
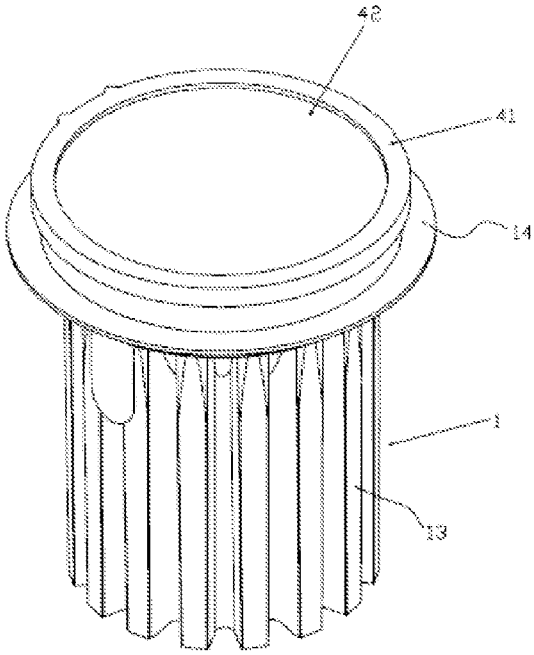
FIG. 9 is a structure diagram of the LED projection lamp provided by the invention when illuminating upwards.

(2) When the Projection Lamp Illuminates Upwards:

As illustrated in FIG. 9, when the projection lamp illuminates at the angle, the LED module 3 as the heat source is disposed on the upper part relative to the first heat conduction component 5 and disposed on the lower part relative to the second heat conduction component 8. That is to say, in the state, the second heat conduction component 8 has higher heat conduction efficiency compared with the first heat conduction component 5. Therefore, the second heat conduction component 8 has the function of primary heat dissipation. As illustrated in FIG. 10, the heat dissipation path of the second heat conduction component 8 is as follows: the heat is transmitted from the LED module 3 to the second vapor chamber 81; and one part of the heat in the second vapor chamber 81 is directly transmitted to the heat sink 1 and the fastening device 7 and the other part of the heat in the second vapor chamber 81 is transmitted to the second heat pipe component 82 first and then transmitted to the heat sink 1 and the fastening device 7 by the second heat pipe component 82. The first heat conduction component 5 has the function of secondary heat dissipation. As illustrated in FIG. 10, the heat dissipation path of the first heat conduction component 5 is as follows: the heat is transmitted from the LED module 3 to the first vapor chamber 51; one part of the heat in the first vapor chamber 51 is directly transmitted to the heat sink 1 and the lamp cup 2 and the other part of the heat in the first vapor chamber 51 is transmitted to the first heat pipe component 52 first and then transmitted to the heat sink 1 and the lamp cup 2 by the first heat pipe component 52.

Of course, the above only illustrates the heat dissipation process under extreme situations and more illumination angles may be required during the actual application. However, due to the interaction between the first heat conduction component 5 and the second heat conduction component 8, the above heat dissipation principle will be complied with no matter what the angle is. That is to say, when the LED projection lamp illuminates towards the upper side, the first heat conduction component 5 has the function of primary heat dissipation; and when the LED projection lamp illuminates towards the lower side, the second heat conduction component 8 has the function of primary heat dissipation. Finally, the heat is all transmitted to the heat sink 1, the lamp cup 2 and the fastening device 7 and dispersed by the heat sink 1 playing a leading role via the heat dissipation structure 13 of the heat sink 1. Meanwhile, the lamp cup 2 and the fastening device 7 playing a secondary role also have certain heat dissipating capacity.

As the projection lamp must be multidirectional when used, the power of the first and second heat conduction components must be measured according to the angle applied. Moreover, the total power of the first and second heat conduction components must be more than or equal to the power produced by the LED module.

Of course, the invention is not limited to the above implementations. Those skilled in the art can also make equivalent deformations or replacements on the premise of not departing from the spirit of the invention. The equivalent deformations or replacements shall be all within the scope limited by the claims of the application.

What is claimed is:

1. An LED projection lamp, comprising:

a heat sink, in which the heat sink being cylindrical; a heat dissipation structure arranged on the cylindrical periphery of the heat sink; and a trumpet-shaped inner cavity gradually expanded from inside to outside formed at the front end of a cylindrical inner cavity of the heat sink;

a lamp cup, in which the lamp cup taking the shape of a trumpet matched with the trumpet-shaped inner cavity of the heat sink and having a large opening portion and a small opening portion; the large opening portion clamped on the outer edge at the front end of the heat sink; and the small opening portion disposed in the inner cavity of the heat sink;

an LED module, in which the LED module formed by a plurality of LED chips packaged on an aluminum nitride ceramic wafer and disposed on the small opening portion of the lamp cup;

a lens, in which the lens used by the LED module for light transmission and fixed at the front end of the heat sink through a retainer ring;

a first heat conduction component, in which the first heat conduction component comprising a first vapor chamber bent to form a smoothing section and two symmetrical sections symmetrically disposed on both sides of the smoothing section; the LED module fixed on the front of the smoothing section of the first vapor chamber; the two symmetrical sections of the first vapor chamber extended to the vicinity of the large opening portion from the small opening portion of the lamp cup; inner side faces of the two symmetrical sections of the first vapor chamber being cambered surfaces and adhered to the outerwall of the lamp cup; and outer side faces of the two symmetrical sections of the first vapor chamber being cambered surfaces and adhered to the wall of the trumpet-shaped inner cavity of the heat sink;

a fastening device, in which the fastening device being cylindrical and sleeved at the rear end of the cylindrical inner cavity of the heat sink;

a second heat conduction component, in which the second heat conduction component comprising a second vapor chamber bent to form a smoothing section and two symmetrical sections symmetrically disposed on both sides of the smoothing section; the smoothing section of the second vapor chamber supported and fixed by a mounting plate; the two symmetrical sections of the second vapor chamber sleeved outside the fastening device; inner side faces of the two symmetrical sections of the second vapor chamber being cambered surfaces and adhered to the outerwall of the fastening device; and outer side faces of the two symmetrical sections of the second vapor chamber being cambered surfaces and adhered to the wall of the cylindrical inner cavity of the heat sink; and the mounting plate, in which the mounting plate disposed on the smoothing section of the first vapor chamber; and the first vapor chamber and the second vapor chamber supported and fixed by the mounting plate; wherein the total radiating power of the first and second heat conduction components being more than or equal to the power produced by the LED module; and the heat conduction path being as follows: the heat directly conducted from the LED chips to the aluminum nitride ceramic wafer first, then directly conducted to the vapor chambers, finally conducted to heat pipes, an inner radiator and an outer radiator, and dispersed by fin devices of the radiators via cross-ventilation and radiation, in which the aluminum nitride ceramic wafer, the vapor chambers and the heat pipes being all heat conducting media with low thermal resistance.

2. The LED projection lamp according to claim 1, wherein the first heat conduction component also comprises a first heat pipe component having at least one heat pipe which is bent and surrounds the periphery of the lamp cup; a first groove for receiving the first heat pipe component is formed on the outerwall of the lamp cup; and the outside of the heat pipe of the first heat pipe component makes contact with the wall of the trumpet-shaped inner cavity of the heat sink and the inner side faces of the two symmetrical sections of the first vapor chamber.

3. The LED projection lamp according to claim 1, wherein the second heat conduction component also comprises a second heat pipe component having at least one heat pipe which is bent and surrounds the periphery of the fastening device; a second groove for receiving the second heat pipe component is formed on the outerwall of the fastening device; and the outside of the heat pipe of the second heat pipe component makes contact with the wall of the cylindrical inner cavity of the heat sink and the inner side faces of the two symmetrical sections of the second vapor chamber.

4. The LED projection lamp according to claim 2, wherein one side of the heat pipe of the first heat pipe component, which makes contact with the first vapor chamber and the wall of the trumpet-shaped inner cavity of the heat sink, is subjected to flattening treatment.

5. The LED projection lamp according to claim 3, wherein one side of the heat pipe of the second heat pipe component, which makes contact with the second vapor chamber and the wall of the cylindrical inner cavity of the heat sink, is subjected to flattening treatment.

6. The LED projection lamp according to claim 1, wherein a first clamping groove into which the smoothing section of the first vapor chamber is clamped is formed on the front of the mounting plate; and a second clamping groove into which the smoothing section of the second vapor chamber is clamped is formed at the rear of the mounting plate.

7. The LED projection lamp according to claim 1, wherein an outward flange is formed on the outer edge at the front end of the heat sink; and the retainer ring is clamped on the outward flange.

8. The LED projection lamp according to claim 1, wherein the lens is a Fresnel lens.

9. The LED projection lamp according to claim 7, wherein the lens is a Fresnel lens.

10. The LED projection lamp according to claim 8, wherein a light-transmitting mirror for covering the lens is clamped on the retainer ring.

11. The LED projection lamp according to claim 9, wherein a light-transmitting mirror for covering the lens is clamped on the retainer ring.

* * * * *